United States Patent [19]

Simonds

[11] 4,440,142

[45] Apr. 3, 1984

[54] COMPOUND BOW CABLE TENSION ADJUSTER

[75] Inventor: Gary Simonds, Gainesville, Fla.

[73] Assignee: Kidde Recreation Products, Inc., Northbrook, Ill.

[21] Appl. No.: 425,682

[22] Filed: Sep. 28, 1982

[51] Int. Cl.[3] ..... F41B 5/00

[52] U.S. Cl. ..... 124/23 R; 124/DIG. 1

[58] Field of Search ..... 124/23 R, 24 R, 90, 124/DIG. 1, 80

[56] References Cited

U.S. PATENT DOCUMENTS

| | | | |
|---|---|---|---|
| 4,054,118 | 10/1977 | McKee et al. | 124/23 R |
| 4,300,521 | 11/1981 | Schmitt | 124/DIG. 1 X |
| 4,337,749 | 7/1982 | Barna | 124/DIG. 1 X |
| 4,353,346 | 10/1982 | Barna | 124/24 R |

*Primary Examiner*—Richard J. Apley
*Assistant Examiner*—William R. Browne
*Attorney, Agent, or Firm*—Emory L. Groff, Jr.

[57] ABSTRACT

An adjustable arrangement for anchoring the ends of each tension cable in a compound bow includes a displaceable disc cradled in a bridle cable suspended from each bow limb tip. Each disc is provided with a plurality of holes, slots or notches variably spaced from the center of the disc such that the distal portion of a tension cable may be selectively anchored in any one hole, slot or notch thereby allowing tuning of each bow limb by the alternate positioning of the anchored portions of the two tension cables in the respective discs. The slidable, captive engagement between the disc periphery and bridle cable automatically insures maintenance of each tension cable end within a plane passing through the bow centerline.

13 Claims, 6 Drawing Figures

COMPOUND BOW CABLE TENSION ADJUSTER

This invention relates generally to archery bows and more particularly, to improved means for anchoring the tension or power cables in a compound bow.

The earliest versions of the modern compound bows were of the direct feed-back system comprising two-wheel or cam bows wherein each one of the two tension cables extending from the eccentric wheel or cam on one limb was anchored to or adjacent the cam axle carried by the opposite limb. Such an arrangement produced a noticeable shortcoming in that no reliable means was provided to achieve a positive and accurate tuning of the bow limbs or cams. Thereafter, numerous versions of four-wheel compound bows were introduced in an effort to provide individual tuneability or adjustment by manipulation of indexing or other means receiving the anchored ends of the two tension cables. In these four-wheel models, the tension cable extending from one eccentric wheel passed over an idler pulley in the center of the opposite limb and was adjustably anchored to a take-up mechanism on or adjacent the bow handle. As is well known to those skilled in the art, the advantage of such an arrangement was that the rotational orientation of one eccentric could more advantageously be changed in relation to the other eccentric, thus affecting tuning and draw length.

Presently, there is a resurgence of interest in the simplicity of the two-wheel version of compound bows, notwithstanding the sacrifice in tuneability. Accordingly, adjustment of the timing of many current two-wheel bows is limited to slipping each cable through the respective eccentric wheel an estimated amount and thereafter anchoring the displaced cable to its wheel with a set screw, a method which is far from being accurate and often requires numerous trial and error attempts before achieving a desired bow set-up. Otherwise, without such an adjustment, the timing is fixed as established at the time of initial assembly of the bow.

With the present invention, structure is provided whereby the tension cables in a two-wheel compound bow may be readily adjusted to achieve a desired cam and limb timing without the hit or miss procedure of slipping the cable through the eccentric wheels or cams. With the instant arrangement, one can change the angular relationship of one eccentric or cam with respect to the other or one can change the angular position of both cams, thus changing the draw length and in an incremental manner.

The present means of adjusting the timing and draw length is very simple and straight forward and provides the further desirable function of distributing the anchored tension cable loads equally on each side of both cams. Additionally, by employing a cam or eccentric wheel having a single track, or multiple tracks in a single vertical plane, all stresses applied by both the bowstring and the tension cables pass through the centerline of the bow.

The timing adjuster of this development comprises an adjuster wheel or disc cradled within a bridle cable suspended from each bow limb adjacent its tip and offers a noticable improvement over the fixed bridle cable attachment system as set forth in U.S. Pat. No. 4,300,521 issued to Schmitt on Nov. 17, 1981. Included is a displaceable adjuster disc provided with a plurality of attachment portions each terminating a different radial distance from the center of the disc such that by selectively positioning the end of a tension cable in one of these attachment portions, each tension cable may be effectively lenthened or shortened a positive amount thereby changing the angular relationship of its corresponding cam or eccentric wheel as carried by the opposed limb. Not only are tuning adjustments more positive, exacting and considerably easier to achieve, but also the archer can optimize his bow set-up to suit his personal shooting style.

Accordingly, one of the objects of the present invention is to provide an improved compound bow tuning adjuster comprising a disc cradled within a bridle cable suspended from each bow limb tip and containing a plurality of attachment portions for selectively engaging the end of a bow tension cable to variably lengthen or shorten the cable.

A further object of the present invention is to provide an improved compound bow having an angularly displaceable adjuster disc cradled within a bridle cable suspended from each bow limb and provided with a plurality of attachment portions therein each terminating a different radial distance from the center of the disc to offer variable attachment means for anchoring the end of a tension cable extending from an opposite limb.

Still another object of the present invention is to provide an improved compound bow tuning adjuster including a disc carried by a bridle cable suspended from each limb tip and having a plurality of elongated slots radiating from the center of the disc and terminating at different distances from the disc center to provide various attachment points for the end of a bow tension cable.

A further object of the present invention is to provide an improved compound bow having a tuning adjuster for anchoring the end of each tension cable and comprising a disc supported by a bridle cable and having an enlarged cable opening from which extend a plurality of attachment portions each terminating a dffierent radial distance from the center of the disc for selectively receiving the end of a tension cable.

With these and other objects in view which will more readily appear as the nature of the invention is better understood, the invention consists in the novel construction, combination and arrangement of parts hereinafter more fully described, illustrated and claimed.

Similar reference characters designate corresponding parts throughout the several figures of the drawings.

Figure 1:
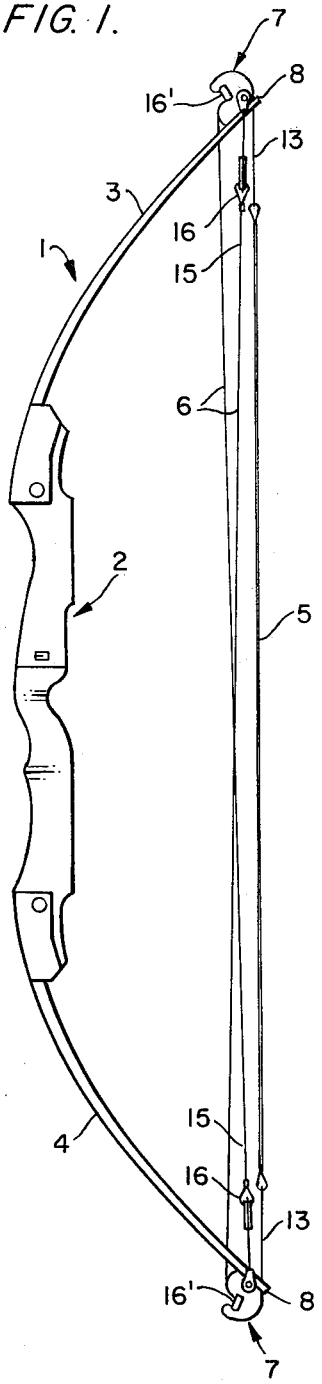
FIG. 1 is a side elevation of a typical compound bow incorporating the tuning adjuster of the present invention.

Referring now to the drawings, particularly FIG. 1, the present invention will be seen to relate to a compound bow, generally designated 1, including a centeral handle section 2 supporting opposite upper and lower limbs 3 and 4 respectively. The exact configuration and construction of these basic bow components applicable to the present invention will be understood not to be critical since many well known bow constructions may be employed which include resilient limbs adapted to be stressed by means of a bowstring 5 and tension or power cables 6 acting through appropriate cam, wheel or pulleys 7 carried at or adjacent the tips 8 of the bow limbs. In the illustrated bow 1, each eccentrically mounted cam or cam element 7 is disposed within a cam slot 9 formed along the center line of each limb and which projects through the limb tip 8. The cam is mounted upon a transverse pivot or mounting shaft 10 which in turn may be supported by means of two pillow blocks 11—11 attached adjacent the bow limb tip 8 as shown most clearly in FIGS. 2 and 3 of the drawings.

Alternative mounting means for bow cam 7 may quite obviously be employed such as by pivotally attaching the cam upon U-shaped brackets (not shown) which in turn may be attached adjacent each bow limb tip. The illustrated manner of attachment is generally preferred since it minimizes the mass weight carried by each limb tip and thus reduces undersirable forces acting upon the limb tips when a drawn bowstring 5 is released.

The bowstring 5 includes opposite ends 12 each preferably removably attachable to one end of the bowstring segment 13 of each tension cable 6. This bowstring segment 13 will be seen to be sheaved within a peripheral groove or track 14 of the adjacent cam 7 and provides the input for the angular displacement of the cams when the bowstring 5 is drawn. Each tension cable 6 will be seen to extend from the opposite, forward side of a respective cam 7 and crosses over toward the vicinity of the opposite bow limb tip or cam 7 wherein it terminates in a tension cable end 15.

In the illustrated compound bow 1, the bowstring segment 13 of each tension cable, as well as the tension cable 6 itself, are unitary or continuous. This feature is possible in view of the use of the illustrated cam 7 which comprises an eccentrically mounted cam provided with the single continuous groove or track 14 having a cable keeper 16' which may be manipulated to anchor a selectively positioned cable engaging the cam. With this arrangement, it will follow that in view of the single, planar groove 14, that both the bowstring 5 and the tension cable 6 will at all times be aligned with the centerline of the bow. It will be understood that this desirable feature enhances the operation of the present invention although, as will be appreciated hereinafter, is not a necessary consideration in order to practice the essence of the invention.

Figure 2:
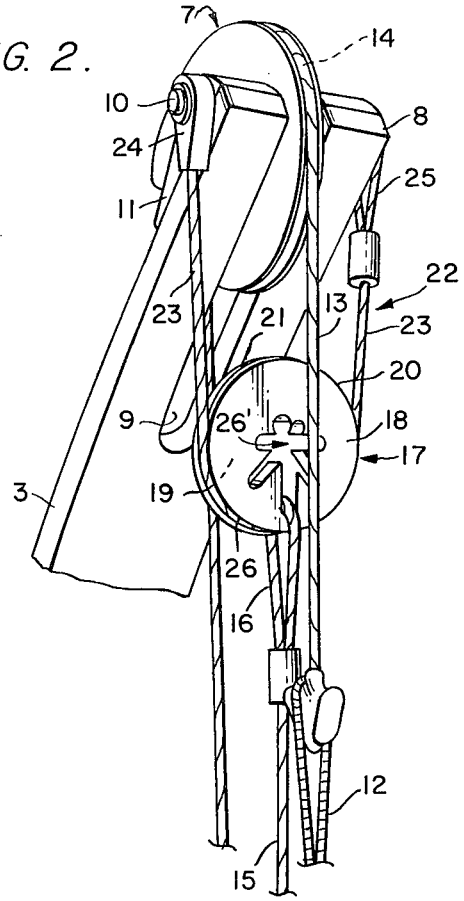
FIG. 2 is an enlarged perspective view illustrating the tuning adjuster associated with one bow limb tip.
Figure 3:
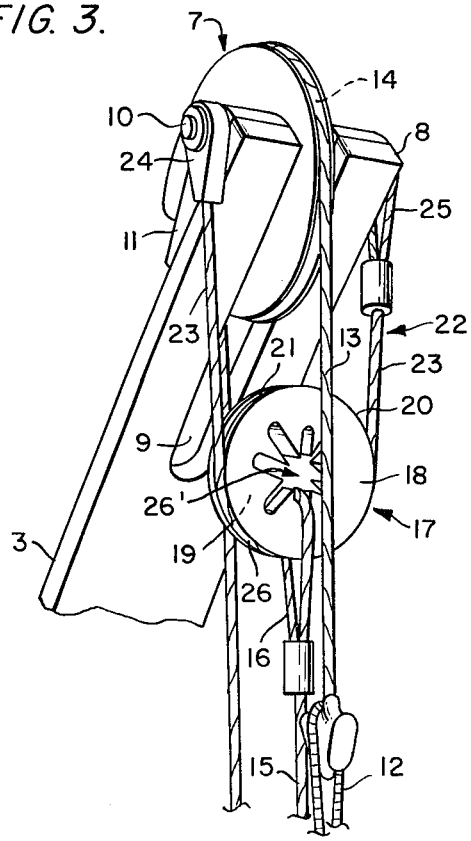
FIG. 3 is a view similar to FIG. 2 and illustrates the tension cable as positioned within an alternate attachment portion of the adjuster disc.

Each tension cable end 15 is provided with a suitable end attachment 16 which as shown in FIGS. 2 and 3 of the drawings, may comprise a loop. Other suitable means for attaching each cable end to the present tuning adjuster mechanism may be considered, such as a hook. The tension cable end attachment 16 is adapted to cooperate with anchor means including an adjuster disc 17 preferably comprising a circular member having opposite and parallel first and second faces 18–19 respectively. The circular peripheral edge 20 is provided with a continuous circumferential or peripheral groove or track 21 of a depth and configuration selected to adequately receive suspension means in the form of a U-shaped bridle cable, generally designated 22. As shown in FIGS. 2 and 3 of the drawings, this bridle cable 22 includes two side portions 23—23, each terminating in an end portion or fitting 24–25 respectively and having a medial cradle loop portion or intermediate portion 26. The referenced end fittings 24–25 may most conveniently by pivotally attached to the same pivot or mounting shaft 10 supporting the respective cams 7 but quite obviously, the ends of the two side portions 23—23 of the bridle cable 22 may be appropriately anchored to a separate bracket (not shown) or any other appropriate device fixed relative each bow limb in the area of the cam 7 or limb tip 8.

The tuning or adjustability feature of the present invention is provided by means of a tension cable end attachment provision 26' formed in each adjuster disc 17. This end attachment provision, as shown in the disc 17 of FIGS. 2–4, will be seen to comprise a common cable opening 27 of an extent incorporating the center point 28 of the disc and from which radially extend a plurality of attachment portions each comprising an elongated slot having an outer radial terminus 29 disposed a different radial distance from the disc center point 28. As shown in the enlarged view of FIG. 4, the plurality of attachment portions are identified respectively as P1, P2, P3, P4, P5, P6 and P7. The number of varied length slots P1–P7 is optional and will only be limited by the diameter or may area of the disc 17. Quite obviously, the greater the number of different length slots, the more the draw force curve of any one bow may be varied through use of this invention.

With the foregoing structure in mind, it will be appreiated that timing of each cam may individually be altered so as to change the draw force curve and actual bow draw length merely by compressing the bow limbs and by selectively repositioning the tenson cable end attachment 16 in any one of the referenced attachment portions P1–P7 of the respective adjuster disc 17. In the example illustrated in FIG. 2, the tension cable is anchored within the attachment portion P7 of the disc to effectively lengthen the respective tension cable 6 the maximum possible amount while in the illustration of FIG. 3, the tension end attachment portion 16 is shown anchored within the disc attachment portion P1 which will be understood to effectively shorten the concerned tension cable 6 the maximum amount. The remaining disc attachment portions P2–P6, as will be seen from FIG. 4, are of intermediate radial distances from the disc center point 28 such that when any one of these latter attachment portions is employed to anchor the concerned tension cable 6, the tension cable will be lengthened or shortened an amount which is intermediate that as provided when the attachment portions P1 or P7 are utilized.

Figure 4:
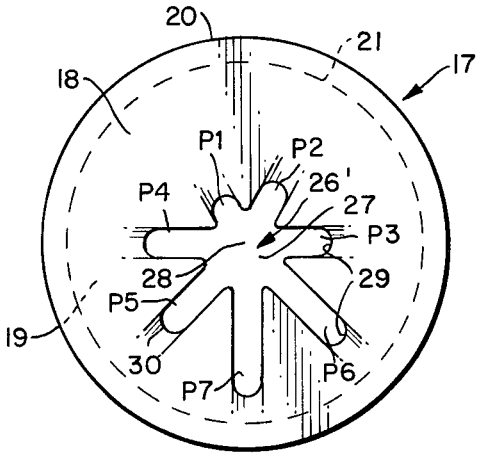
FIG. 4 is an enlarged side elevation of the adjuster disc.

The disc 17 as shown in FIG. 4 of the drawings, further illustrates the provision of a rounded or chamfered surface 30 adjacent the radial terminus 29 of each attachment portion P1–P7 and which construction may be included to minimize any cutting action upon the loop portion 16 of an attached tension cable. 6.

Figure 5:
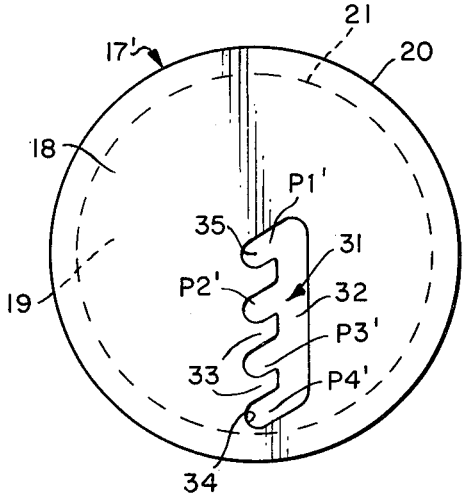
FIG. 5 is an enlarged side elevation of a further embodiment of the adjuster disc.

The adjuster disc 17' shown in FIG. 5 of the drawings offers a modified tension cable end attachment provision 31 comprising an enlarged cable opening 32 in the form of an elongated slot from which angularly extend a plurality of individual attachment portions.

These latter attachment portions comprise elongated slots P1'–P4' separated from one another by a web 33 and each having a bottom-most terminus 34. The adjuster disc 17' is employed to selectively and adjustably attach respective tension cable end attachment 16 by employing the same concept as that utilized in connection with the previously described adjuster disc 17 but instead of rotating the disc to anchor the tension cable end attachment 16 in a selected disc attachment portion, the tension cable is adjustable anchored merely by compressing the bow and shifting the cable end attachment 16 to another one of the disc attachment portions P1'–P4' which is located a different radial distance with respect to the disc center point 35.

Figure 6:
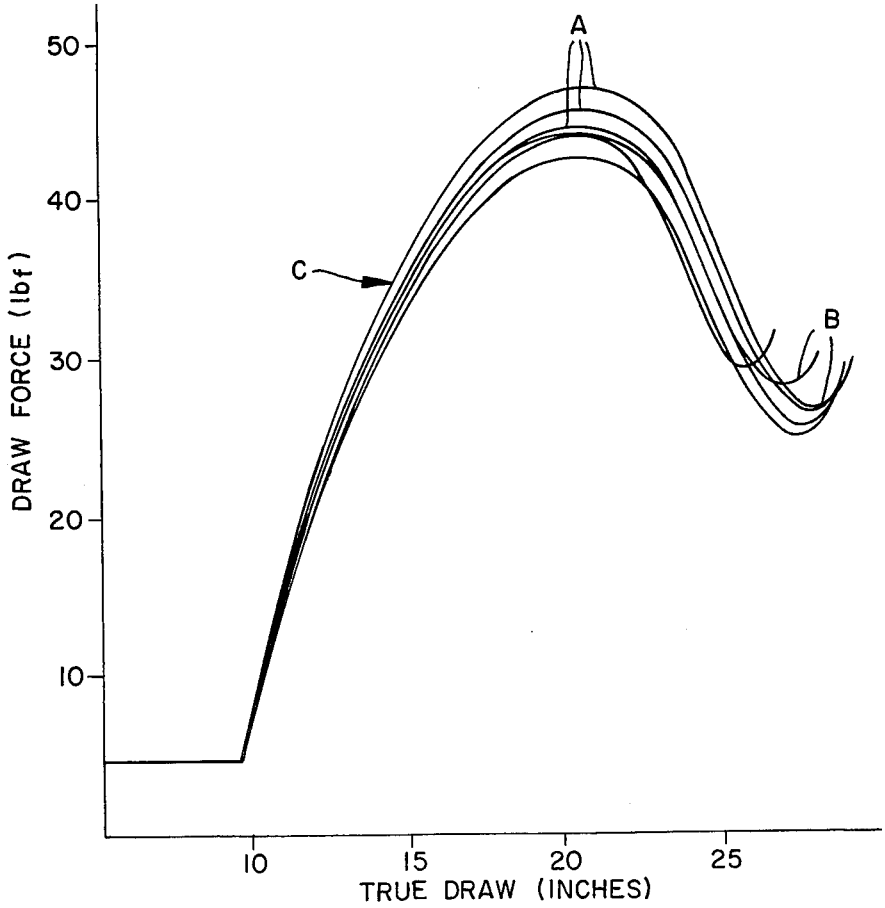
FIG. 6 is a chart graphically representing various draw-force curves obtainable through selective bow tuning by means of the disc of the present invention.

The remaining FIG. 6 of the drawings graphically illustrates various draw force curves C achieved through variations of attachment of tension cables 6 by means of the adjuster disc 17 and 17' of the present invention and depicts the resultant different draw forces A and draw lengths B when anchoring the tension cables by means of the different disc attaching portions P1–P7 or P1'–P4'. These variations are achieved by changing either one or both cable end attachments and thus for some bow set-ups, one cable 6 may be anchored in slot P1 of the upper disc 17 while the other cable 6 is engaged in slot P7 of the lower disc 17.

I claim:

1. A compound bow including, a center handle section supporting upper and lower limbs having tips, a cam element pivotally attached respective each said limb, a tension cable extending from each said cam element of one said limbs, in a cable end attachment adjacent the opposite one of said limbs, said tension cable terminating in said cable end attachment means adjustably anchoring each said cable end attachment relative its respective said limb, said adjustable anchoring means each including a bridle cable having side portions carried by one said limb and an intermediate portion, a disc engaged and supported by said bridle cable intermediate portion, a plurality of attachment portions formed in said disc disposed varying distances from the center of said disc, and said cable end attachment anchored to said disc by engagement with one of said disc attachment portions whereby, each said cable end attachment is selectively engageable in alternate ones of said disc attachment portions to vary the tuning of said bow.

2. A compound bow according to Claim 1 wherein, said disc attachment portions include elongated slots each having a terminus located a different distance from said disc center.

3. A compound bow according to Claim 2 wherein, said tension cable end attachment includes a loop of said tension cable disposed through one said slot.

4. A compound bow according to Claim 2, wherein said slots communicate with a common tension cable opening allowing shifting of said cable end attachment between selected ones of said slots.

5. A compound bow according to Claim 2 wherein, said slots radiate from a common tension cable opening and said tension cable opening encompasses the center point of said disc.

6. A compound bow according to Claim 2 wherein, said slots are substantially parallel and all communicate with a common tension cable opening through said disc.

7. A compound bow according to Claim 6 wherein, said slots extend through a common radial line through said disc.

8. A compound bow according to Claim 2 wherein, each said slot terminus is chamfered.

9. A compound bow according to Claim 2 wherein, said slots extend radially from the center of said disc.

10. A compound bow according to Claim 1 wherein, said disc includes a peripheral groove engageable with said bridle cable intermediate portion.

11. A compound bow according to Claim 10 wherein, said bridle cable side portions provided with end fittings, said cam element disposed along the center line of said bow handle section and limbs, said two end fittings of each said bridle cable pivotally attached to one said bow limb at points equi-distant said cam element whereby, said engaged cable end attachment is disposed along the plane of the bow center line.

12. A compound bow according to Claim 11 wherein, said cam element comprises a planar member and said peripheral groove remains centrally disposed relative said bow center line during pivoting of said cam element.

13. A compound bow according to Claim 1 wherein, said disc includes a circular periphery slidingly engageable by said bridle cable's intermediate portion.

* * * * *

UNITED STATES PATENT AND TRADEMARK OFFICE

CERTIFICATE OF CORRECTION

PATENT NO. : 4,440,142

DATED : April 3, 1984

INVENTOR(S) : Gary Simonds

It is certified that error appears in the above-identified patent and that said Letters Patent are hereby corrected as shown below:

Column 5, line 25, delete "in"

line 27, place a comma (,) after "attachment".

Signed and Sealed this

*Ninth* Day of *April 1985*

[SEAL]

*Attest:*

DONALD J. QUIGG

*Attesting Officer* *Acting Commissioner of Patents and Trademarks*